US009909243B2

(12) United States Patent
Hosaka et al.

(10) Patent No.: US 9,909,243 B2
(45) Date of Patent: Mar. 6, 2018

(54) SEWING MACHINE

(71) Applicant: Janome Sewing Machine Co., Ltd., Tokyo (JP)

(72) Inventors: Yukio Hosaka, Tokyo (JP); Hayato Takada, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 106 days.

(21) Appl. No.: 15/000,465

(22) Filed: Jan. 19, 2016

(65) Prior Publication Data

US 2016/0289876 A1 Oct. 6, 2016

(30) Foreign Application Priority Data

Apr. 2, 2015 (JP) ..... 2015-075973

(51) Int. Cl.
*D05B 19/00* (2006.01)
*D05B 79/00* (2006.01)
*D05C 13/02* (2006.01)

(52) U.S. Cl.
CPC ..... *D05B 19/006* (2013.01); *D05B 19/00* (2013.01); *D05B 79/00* (2013.01); *D05C 13/02* (2013.01); *D05D 2205/12* (2013.01)

(58) Field of Classification Search
CPC ..... D05B 19/00–19/16; D05B 79/00; G05B 2219/2626; G05B 2219/45195; D05C 13/02; D05D 2205/12
See application file for complete search history.

(56) References Cited

U.S. PATENT DOCUMENTS 4,293,778 A * 10/1981 Williams ..... G08B 13/126 307/147
5,078,067 A * 1/1992 Nakashima ..... D05B 81/00 112/104
5,247,449 A * 9/1993 Yoshida ..... D05B 69/18 112/277

FOREIGN PATENT DOCUMENTS

EP 810313 A2 * 12/1997
JP 01201297 A * 8/1989
JP 2-34197 A 2/1990
JP 10-328455 A 12/1998
JP 11104381 A * 4/1999
JP 2002172292 * 6/2002

* cited by examiner

*Primary Examiner* — Ismael Izaguirre
(74) *Attorney, Agent, or Firm* — Nields, Lemack & Frame, LLC

(57) ABSTRACT

In one preferred mode, the operator selects by the touch panel 2 a pattern from the displayed patterns on the display 1 and starts the embroidery by operation of the start/stop switch. The CPU 10 is checking the detection signal from the sensor 3 and when the signal is on, the CPU 10 keeps the display 1 in operation. When the operator goes out from the sensor detectable area 60, the signal of the sensor 3 disappears and the CPU 10 generates the LED display 4 indicating the progress of the sewing. Since the operator can see the LED display 4 from the outside of the display visible area 61, the operator recognizes the conditions of the machine A.

8 Claims, 5 Drawing Sheets

SEWING MACHINE

TECHNICAL FIELD

The present invention relates to a sewing machine.

BACKGROUND ART

A sewing machine having an embroidery mechanism is popular and such sewing machines are developing, for example, the area of embroidery is becoming wider, more multicolored and the number of needle is increasing. With such developed machines, it takes several hours to complete embroidery, an exchange of a needle thread is also increasing. Most sewing machines have a function to stop automatically at the time of this exchange and to indicate a thread should be exchanged.

CITATION LIST

Patent Literature

[PTL 1] JP-A-1990(H02)-034197
[PTL 2] JP-A-1998(H10)-328455

SUMMARY OF THE INVENTION

Technical Problem

Therefore an operator has to be in front of the sewing machine until completion of sewing in the conventional sewing machine, and it is necessary to watch the stitch state of the embroidery by a display also exchange a needle thread, that burdens an operator heavily.

The present invention is provided in order to solve the above-described problems.

Solution to Problem

In order to achieve the above-described object, the sewing machine of the invention comprises, a display indicating a condition of the sewing machine, a sensor sensing a person being in a sensor detectable area predetermined around the sewing machine, a notice device for informing a person being outside of said area of said condition of the sewing machine, and a generating device for generating said notice device when said sensor does not detect a person in said area.

In the preferable embodiment, said notice device is a light emitting display like as a LED display visually notifying said condition of the sewing machine. Preferably the light emitting display displays a bar shape indication and emits at least two colors to indicate progress steps of the sewing by length ratio of the colors in said bar indication.

In the case that the sewing machine has an embroidery mechanism, preferably said light emitting display indicates the progress steps of sewing of current thread color by said length ratio of the colors and notifies an operator of the end of sewing of the thread color by flashing said indication.

In the preferable embodiment, said light emitting display is provided on an upper arm part of the sewing machine, said sensor detectable area is almost the same as a display visible area of said display, and an area where said notice device can notify is wider than said sensor detectable area and said display visible area. Said notice device can have a sound emitting device audibly notifying said condition of the sewing machine.

Advantageous Effects of Invention

According to the sewing machine of the present invention, even if the operator is not in the predetermined area around the sewing machine, he can recognize the status of the sewing machine by the notice device generated by the generating device.

DESCRIPTION OF EMBODIMENTS

The invention will now be described in reference to the drawings.

Figure 1:
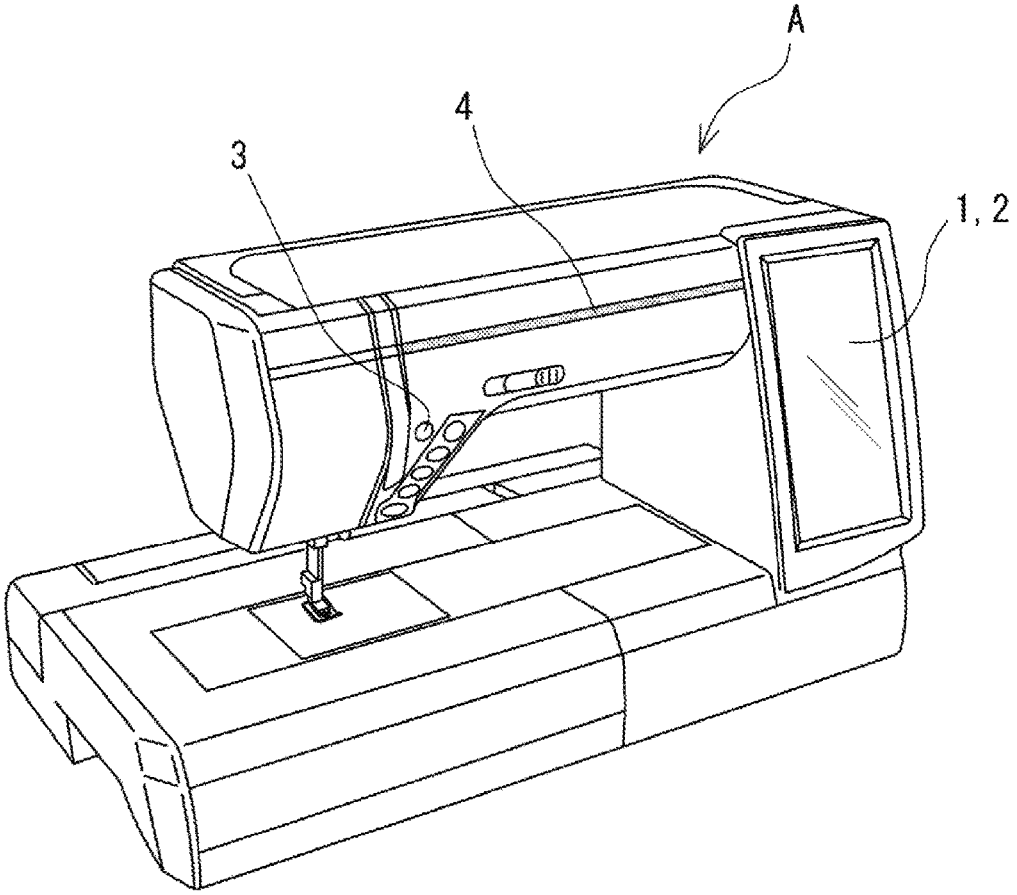
FIG. 1 A perspective view of an embodiment of the sewing machine.

In FIG. 1, a sewing machine A is provided at a front side with a display 1 that shows information like as a sewing progress.

The display 1 is a liquid crystal display serving additionally as a touch panel 2, by which an operator can select a sewing mode, a sewing pattern and other operations.

At the front side of the sewing machine A, a sensor 3 is provided that detects a person existing in front of the machine A.

A LED display 4 is provided on the front side of the sewing machine A, the display 4 is long sideways and can display red, green, blue and other colors.

Figure 2:
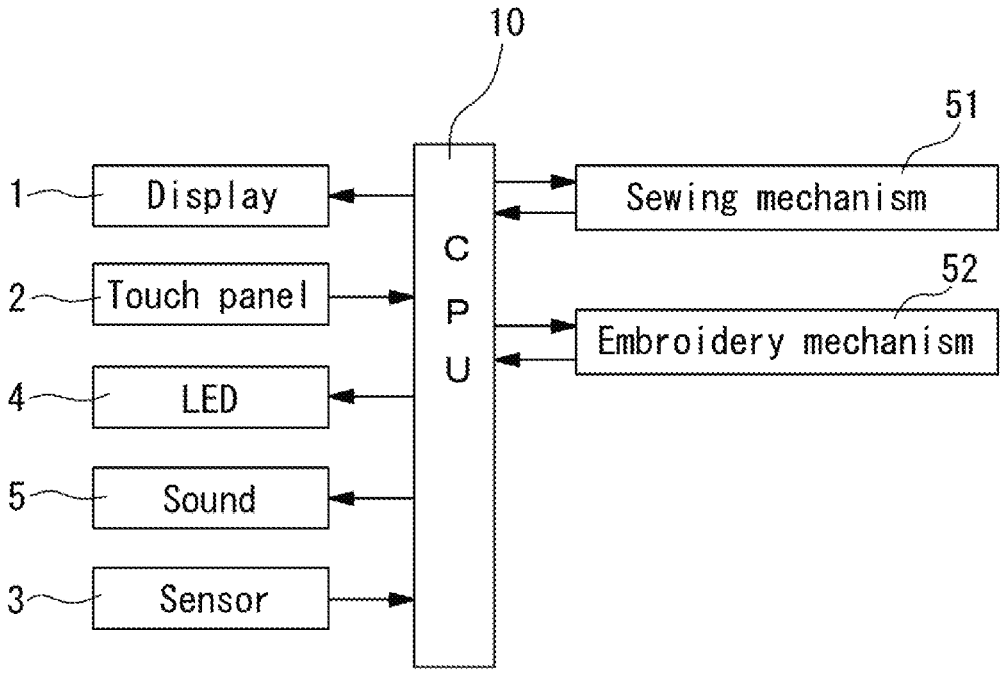
FIG. 2 A block diagram of the embodiment.

FIG. 2 shows a block diagram of the machine A. The sewing machine A has a sewing mechanism 51 and a embroidery mechanism 52. The machine A is entirely controlled by a CPU 10 and the sewing mechanism 51 and the embroidery mechanism 52 perform sewing operation under the control of the CPU 10.

Said display 1 receives signals from the CPU 10 and carries out the various indications according to the signals. The CPU 10 carries out various controls corresponding to instructions from the touch panel 2.

The sensor 3 detects an operator or other person being in a detection area and sends the detection signal to the CPU 10.

The LED display 4 becomes operative by the instruction of the CPU 10 to display various information when the sensor 3 detects no one is in the detection area.

A sound notice device 5 is equipped in the embodiment and the device 5 becomes operative by the signal from the CPU 10 and transmits information by sound when the sensor 3 detects that no one is in the sensor detection area.

The sensor 3 is a human sensor recognizing a human being by detecting a moving object with certain temperature.

Figure 3:
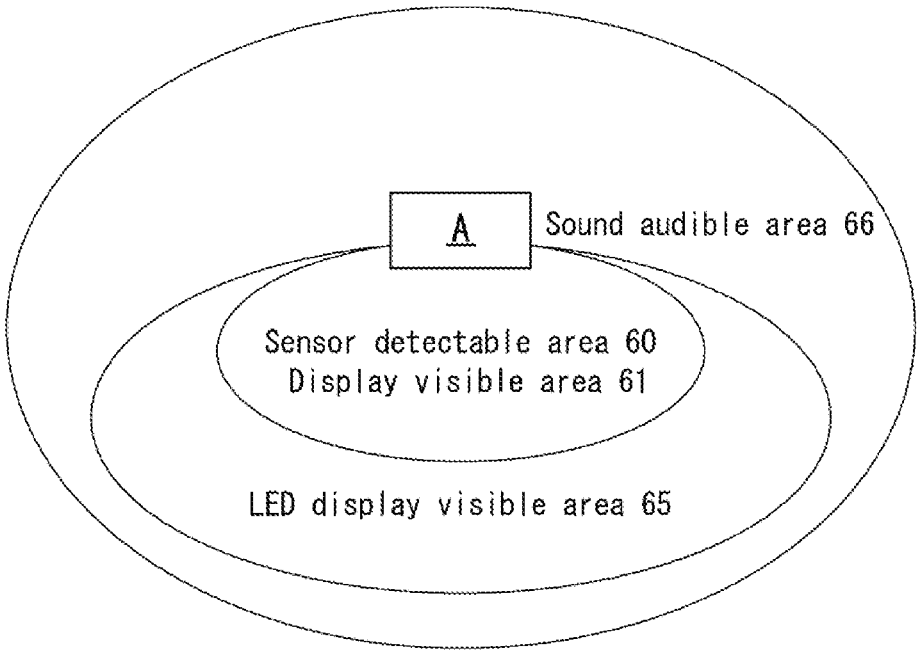
FIG. 3 An explanatory view of a sensor detectable area, a display visible area, a LED display visible area, and a sound audible area FIG. 4 A partial view of the embodiment.

The sensor 3 is provided at an underpart of an arm at the front side of the machine A. As shown in FIG. 3, a sensor detectable area 60 of the sensor 3 is in front of the machine A and the sensor 3 detects a person being in the area 60.

A display visible area 61 is an area where the display 1 can be seen. When the operator is in the area 61, the operator can see the display 1 and recognize the displayed information.

As shown in FIG. 3, said sensor detectable area 60 is set almost the same as the display visible area 61. Thus when the operator goes out of the display visible area 61 where the operator can see the display 1, the sensor 3 can detect surely that no one is in the display visible area 61.

Figure 4:
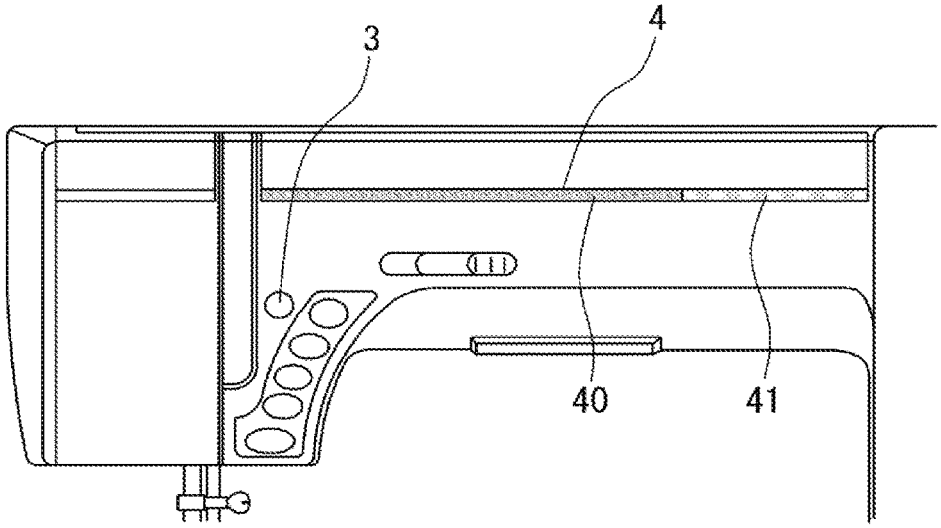
Figure 5:
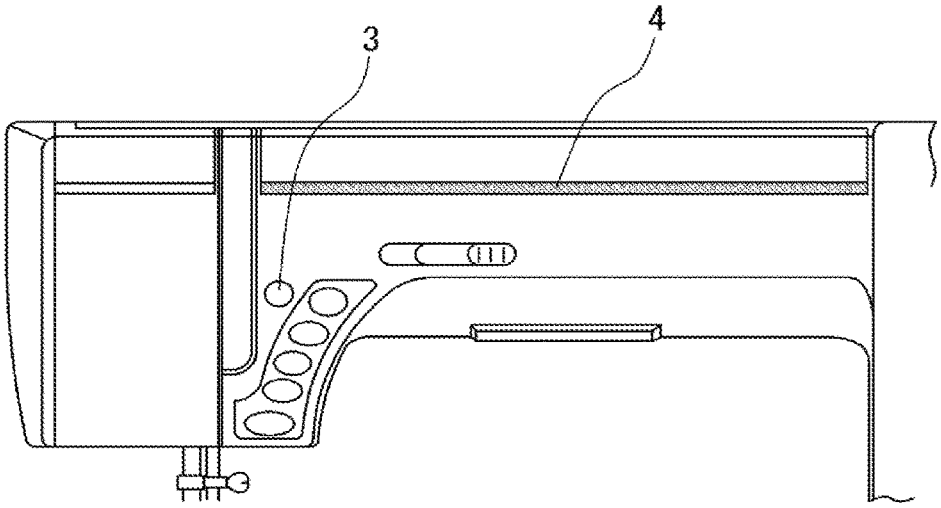
FIG. 5 A partial view of the embodiment.

The LED display 4 having a plural of LED elements is rectangle and is provided laterally in a bar shape on the upper arm part of the machine A as shown in FIGS. 4 and 5. The LED display 4 can display a red indication 40 and a green indication 41 and the progress status of sewing operation can be shown by changing the ratio of the length of the indications 40 and 41.

The LED display 4 can be flashing as shown in FIG. 5 and other various displays can be done with the display 4. In the embodiment, when sewing of a color is finished the display 4 starts flashing to notify the operator to change the upper thread of the color.

Since the LED display 4 has LED elements which emit light and displays color, furthermore the LED display 4 extends in the lateral direction on the arm of the machine A, the LED display 4 provides wider visual area the operator can recognize the display 4 than the display 1 using liquid crystal display.

As shown in FIG. 3, a LED display visible area 65 of the LED display 4 is wider than the display visible area 61 of the display 1 and the operator can see the LED display 4 from the outside of the sensor detectable area 60. Thus the operator can recognize the sewing progress status of the machine A by watching the LED display 4 from the outside of the sensor detectable area 60.

The LED display visible area 65 of the LED display 4 can be expanded or reduced as the occasion demands by selecting the brightness, the location or the like of the display 4.

A sound notice device 5 is provided the inside of the machine A and it notices the state of the machine A to the operator by a speaker with voice, melody and buzzer sounds or the like. A sound audible area 66 is larger than the LED display visible area 65 and the area 66 extends to the front side and the backside of the machine.

In this embodiment, the display 1 and the LED display 4 (and sound notice device 5) are alternatively operative. When the operator is in the sensor detectable area 60, the sensor 3 detects it and the CPU 10 makes the display 1 in operation and makes the LED display 4 (and the sound notice device 5) in no-operation. When the sensor 3 does not detect a person in the area 60, the LED display 4 (and the sound notice device 5) is in operation and the display 1 is not in operation.

Furthermore other embodiment is possible such that when the sensor 3 does not detect a person, both display 1 and LED display 4 (and the sound notice device 5) is in operation.

The LED display 4 and the sound notice device 5 can be used at the same time or either of them can be used independently. Further the display 4 and the device 5 can be selectively used depending on the content to be notified.

Many variations of displays by the LED display 4, the sounds by the sound notice device 5 and the combinations of displays and sounds can be used. For example, in the cases that the machine A unexpectedly stops, or an upper or bobbin thread is short or cut, the sound notice device 5 may produce buzzer sounds and simultaneously the LED display 4 can be turning on and off.

Figure 6:
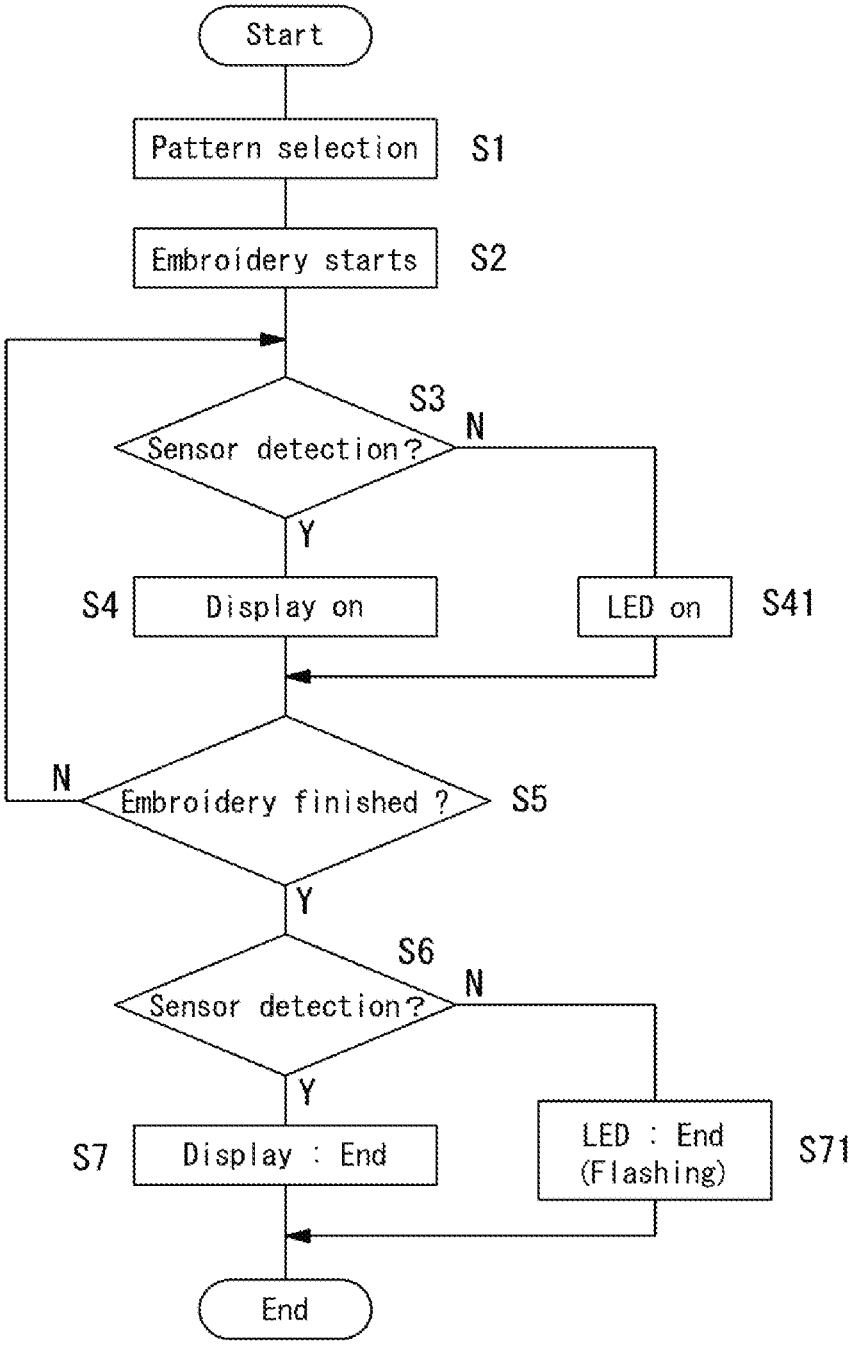
FIG. 6 A flow chart of the operation of the embodiment.

The operation of the embodiment will be explained referring to FIG. 6. The operator selects a pattern to be embroidered in front of the machine A. The operator operates the touch panel 2 and selects a pattern from patterns displayed on display 1 (step S1), then pushes a start switch to start embroidery (step S2).

The CPU 10 keeps checking the signal of detection from the sensor 3. In the case that the signal of the sensor 3 is on, i.e. the operator exists in the sensor detectable area 60, the display 1 keeps being in operation. The display 1 indicates the conditions of the machine A, for example the progress steps of sewing of the color and the number of needle steps for the next change of the upper string of the color (step S4).

When the operator goes out from the sensor detectable area 60, the signal from the sensor 3 disappears and then the CPU 10 determines no person is in the sensor detectable area 60 and generates the LED display 4(step S41). The LED display 4 indicates the progress of the sewing of the machine A, for example the progress steps of the sewing of the present color is indicated in the length ratio of the indications 40 and 41 as shown in FIG. 4.

The operator can see the LED display 4 form the outside of the sensor detectable area 60 and the operator can recognize the progress steps of the sewing and how long to the next changing of the thread. As mentioned the display 1 can be either in operation or out of operation when the LED display 4 is in operation.

When the sewing of the present color finishes, the LED display 4 indicates the finish by flashing the LEDs and the operator recognize the finish of the end of the sewing of the color. Then the operator moves to the machine A for changing an upper thread and the sensor 3 detects the operator in the sensor detectable area. By the detection, the CPU 10 switches off the LED display 4 and indicates the next color to be embroidered on the display 1 (step S4).

After the sewing of the last color is finished and the embroidery is finished (step S5), the end of the embroidery is displayed. In the case of that the operator is in the sensor detectable area 60 (step S6 Y), the display 1 displays the indication of the end of the embroidery (step S7). In the case of that the operator is out of the sensor detectable area 60 (step S6 N), the LED display 4 flashes to indicate the end of the embroidery (step S71).

With the embodiment and operation explained above, the operator can recognize the condition of the machine A with the LED display 4 or the sound notice device 5 even when being in the outside of the sensor detectable area 60.

REFERENCE SIGNS LIST

1: display, 2: touch panel, 3: sensor, 4: LED display, 5: sound notice device, 10: CPU, 40: red indication, 41: green indication, 51: sewing mechanism, 52: embroidery mechanism, 60: sensor detectable area, 61: display visible area, 65: LED display visible area, 66: sound audible area.

The invention claimed is:

1. A sewing machine comprising:

A display indicating the progress steps of the sewing machine operation,

A sensor sensing a person being in a sensor detectable area predetermined around the sewing machine, A notice device for informing a person being outside of said sensor detectable area of said progress steps of the sewing machine operation, A generating device for generating said notice device when said sensor does not detect a person in said area.

2. The sewing machine according to claim 1, wherein said notice device is a light emitting display providing visual notification of said progress steps of the sewing machine operation.

3. The sewing machine according to claim 2, wherein

Said light emitting display displays a bar shape indication and emits at least two colors to indicate said progress steps of the sewing machine operation by the length ratio of the colors in said bar indication.

4. The sewing machine according to claim 3 further having an embroidery mechanism, wherein Said light emitting display indicates the progress steps of the sewing machine operation of a current thread color by said length ratio of the colors in said bar indication and notifies an operator of the end of sewing of the current thread color by flashing said indication.

5. The sewing machine according to claim 1 wherein

Said sewing machine has an upper arm part, and wherein said light emitting display is provided on said upper arm part of the sewing machine.

6. The sewing machine according to claim 1, wherein

Said sensor detectable area is almost the same as a display visible area of said display.

7. The sewing machine according to claim 1, wherein

An area where said notice device can notify is wider than said sensor detectable area and said display visible area.

8. The sewing machine according to claim 1, wherein

Said notice device has a sound emitting device for audible notification of the progress steps of the sewing machine operation.

* * * * *